US005095292A

United States Patent [19]

Masterton

[11] Patent Number: 5,095,292

[45] Date of Patent: Mar. 10, 1992

[54] MICROSTRIP TO RIDGE WAVEGUIDE TRANSITION

[75] Inventor: Brent Masterton, Colton, Calif.

[73] Assignee: Hughes Aircraft Company, Los Angeles, Calif.

[21] Appl. No.: 572,511

[22] Filed: Aug. 24, 1990

[51] Int. Cl.[5] ..... H01P 5/107

[52] U.S. Cl. ..... 333/26; 333/33

[58] Field of Search ..... 333/21 R, 26, 33, 34

[56] References Cited

U.S. PATENT DOCUMENTS 3,518,579 6/1970 Hoffman ..... 333/21 R
4,453,142 6/1984 Murphy ..... 333/26
4,973,925 11/1990 Nusair et al. ..... 333/26

FOREIGN PATENT DOCUMENTS 3019523 11/1981 Fed. Rep. of Germany ..... 333/26
2142481 1/1985 United Kingdom ..... 333/26

*Primary Examiner*—Paul Gensler
*Attorney, Agent, or Firm*—Wanda K. Denson-Low

[57] ABSTRACT

This microstrip to ridge waveguide transition includes a microstrip dipole and a double-ridge waveguide transmission line. The microstrip dipole is centered on the open end of the waveguide and the gap between the dipole and the open end of the waveguide is adjusted for optimum VSWR. The energy is coupled directly and efficiently from the microstrip dipole to the ridges in the waveguide, without the requirement of any direct connections or extra enclosure.

11 Claims, 2 Drawing Sheets

MICROSTRIP TO RIDGE WAVEGUIDE TRANSITION

BACKGROUND OF THE INVENTION

The present invention relates to microwave transmission lines, and more particularly to an apparatus for transitioning between a microstrip transmission line and a ridge waveguide.

Many modern phased array antenna designs use microstrip phase shifters, which are integrated with dipoles on the same circuit. In order to test these integrated circuits in production, a test station consisting of a computer controlled network analyzer with coaxial connector test ports is utilized. This network analyzer system uses error modeling techniques to increase the accuracy of the measurements. The test station must provide a low loss, low VSWR transition from the coaxial connectors to the dipole of the integrated circuit, to minimize errors thereby increasing the accuracy of the measurements.

One previous approach was to enclose one incident (circuit under test) dipole and one receive dipole in a cutoff waveguide section. This approach was extremely sensitive to the position of the incident dipole with respect to both the receive dipole and the waveguide section. This dipole-to-dipole transition also required the insertion of the incident dipole into the waveguide, increasing the possibility of misalignment and damage to the circuit under test. The VSWR and insertion loss bandwidth obtained by a dipole-to-dipole transition used on previous test stations was on the order of 10 to 15 percent.

SUMMARY OF THE INVENTION

It is therefore an object of the present invention to provide an improved microstrip to ridge waveguide transition.

This microstrip to ridge waveguide transition consists of a microstrip dipole and a double-ridge waveguide transmission line. A microstrip dipole is centered on the open end of the waveguide and the gap between dipole and the open end of the waveguide is adjusted for optimum VSWR. A unique feature of this transition is that the energy is coupled directly and efficiently from the microstrip dipole to the ridges in the waveguide, without any direct connections or extra enclosure required.

The advantages of this transition include the following:

1. Broader VSWR bandwidth and lower loss are obtained.
2. This transition is less sensitive to the physical positioning of the dipole than prior transition circuits.
3. Since the dipole is not inserted into waveguide, more elaborate and costly sliding test fixtures are not needed.
4. Existing double-ridge waveguide to coaxial transitions can be used to attach the new transition to the coaxial connector test ports of a network analyzer test station.

BRIEF DESCRIPTION OF THE DRAWINGS

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
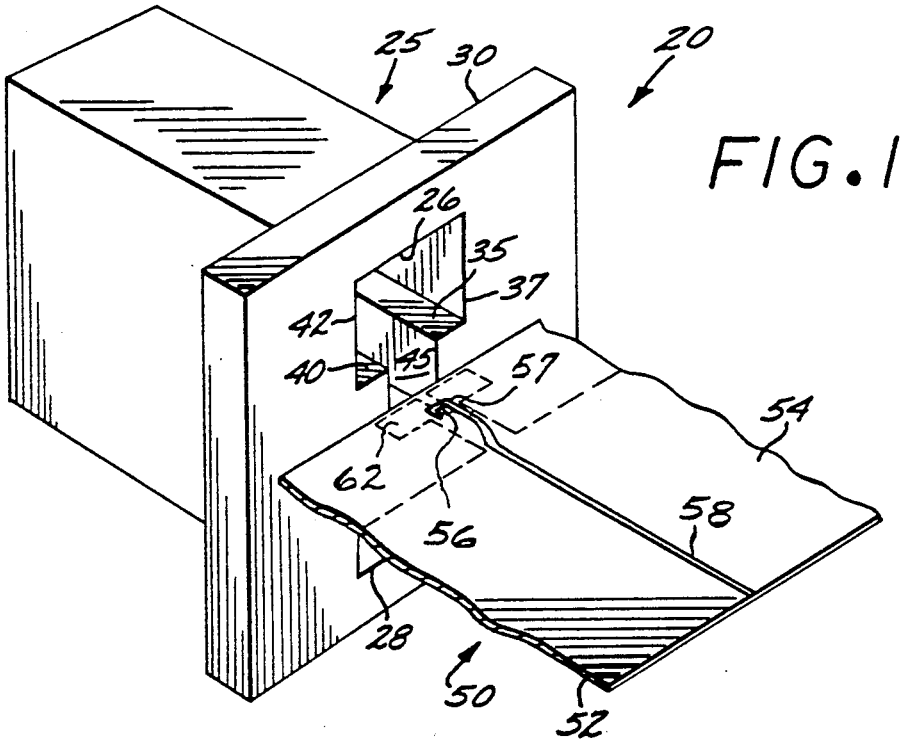
FIG. 1 is a perspective view of a preferred embodiment of a microstrip to ridge waveguide transition in accordance with the invention.

A microstrip to waveguide transition in accordance with the invention comprises a microstrip circuit defining a balun network and dipole, and a double-ridge waveguide transmission line. The perspective view of FIG. 1 illustrates the preferred embodiment of the invention. Here, the transition device 20 comprises a conventional double-ridge waveguide 25 with a flange 30. The double ridges 35 and 40 extend from the long side walls 37 and 42 of the waveguide transmission line 25 into the interior of the waveguide 25.

In this embodiment the waveguide 25 is a standard double ridge WRD-750 waveguide. The flange 30 is square, with sides of length 1.375 inches. The longitudinal and lateral cross-sectional dimensions of the waveguide 25 ar 0.691 and 0.321 inch, respectively. The cross-sectional width of the waveguide at the ridge is 0.136 inch. The cross-sectional, longitudinal length of the ridge is 0.173 inch.

The circuit element 50 is fabricated using microstrip technology in this exemplary embodiment. The planar dielectric substrate 52 is selectively patterned on a circuit side 54 of the substrate with a conductive layer (such as copper) to define the balun 56 and conductor feed line 58. The dielectric substrate 52 is selectively patterned on a ground plane side 60 to define a slotted dipole 62 coupled to ground plane 64.

The selectively patterning of microstrip circuits is well known in the art, and is commonly performed using photolithographic techniques.

Figure 2:
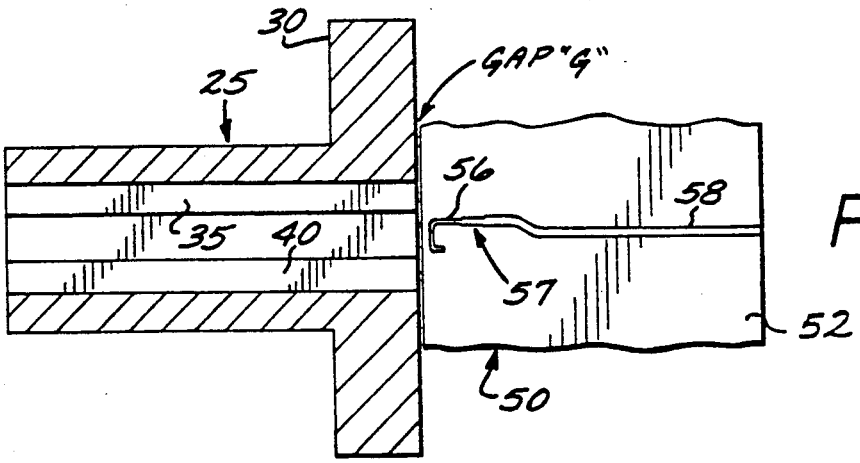
FIG. 2 is a cross-sectional view of the transition of FIG. 1, showing the balun on the circuit side of the microstrip circuit element.

The circuit side 54 of the circuit element 50 is more clearly shown in the cross-sectional top view of FIG. 2. As shown in FIG. 2, the width of the conductor line 58 is stepped down from its initial width, characterized by a 50 ohm characteristic impedance, to a first narrower line width at line section 57 characterized by a 60 ohm characteristic impedance, and finally to a balun line width characterized by a characteristic impedance of 70 ohms. This impedance transformation is used to match to the balun impedance and then to the slot impedance of 100 ohms on the dipole.

Figure 3:
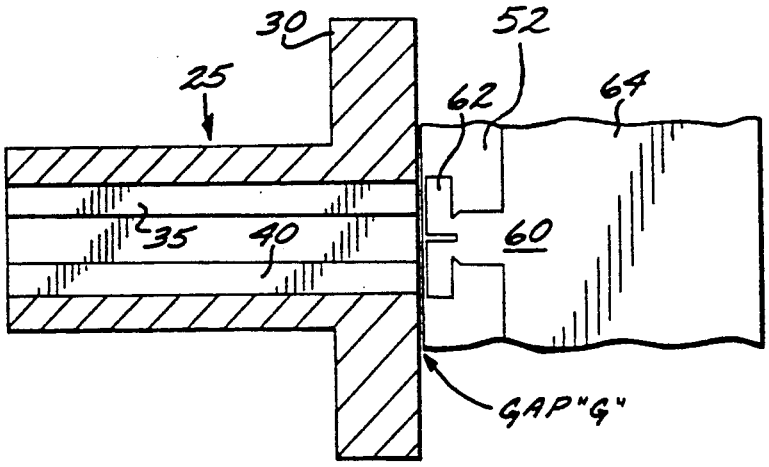
FIG. 3 is a cross-sectional view of the transition of FIG. 1, showing the dipole on the ground plane side of the microstrip circuit element.

The ground plane side of the microstrip circuit element is shown in the cross-sectional bottom view of FIG. 3. As shown in FIGS. 2 and 3, the balun 56 is positioned directly over the dipole 62, so that energy may couple between the balun and the slot to drive the dipole 62. In accordance with the invention, the circuit element 50 is arranged in close juxtaposition with the ridge waveguide element 25 so that the plane of the circuit element 50 is parallel with, and intermediate the planes of the end walls 26 and 28 of the waveguide element 25 with a gap "g" between the flange 30 of the waveguide 25 and the edge of the microstrip circuit element. No direct electrical contact is made between the waveguide element 25 and the microstrip circuit 50.

In operation, the printed circuit element 50 is centered on the open end 45 of the waveguide 25, and the gap "g" between the waveguide 25 and the circuit element 50 is adjusted for optimum VSWR. Microwave energy is coupled directly and efficiently from the microstrip dipole 62 to the ridges 35 and 40 in the waveguide 25, without any direct connections or extra enclosure required for the transition. The size of the gap "g" is adjusted for minimum insertion loss over the frequency band of interest, e.g., approximately 0.02 inches for the exemplary embodiment of FIGS. 1–3. The printed circuit 50 is centered in both the horizontal and the vertical axes with respect to the waveguide opening. This adjustment is not critical to the operation of the transition.

Figure 4:
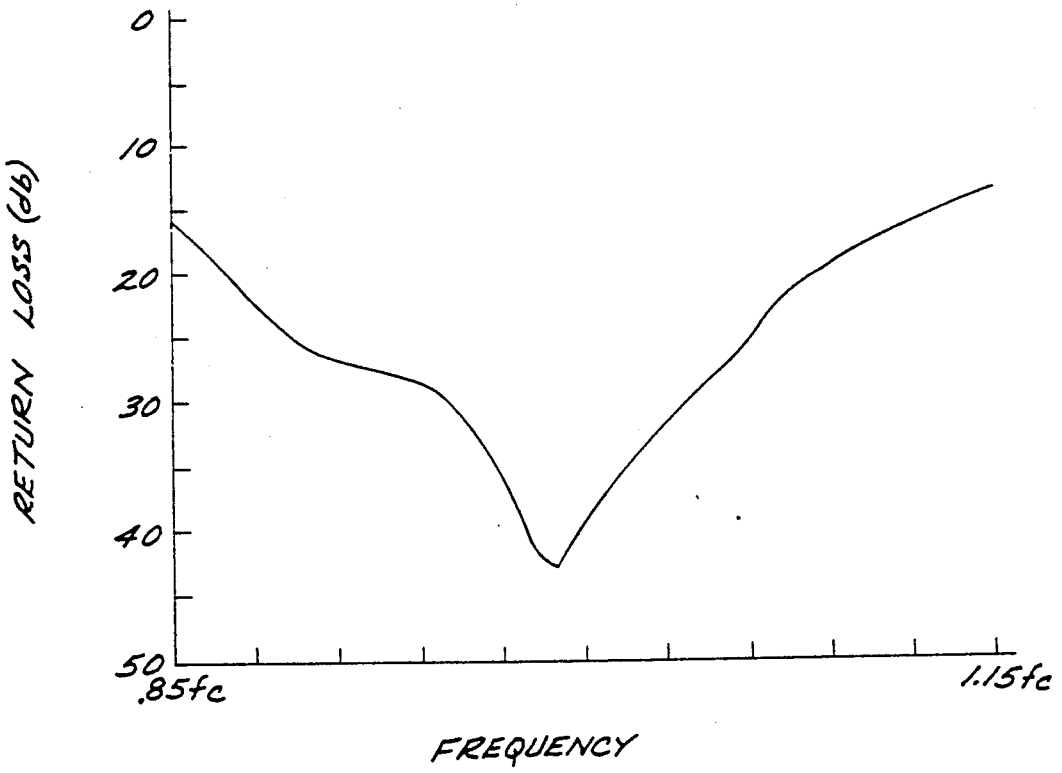
FIGS. 4 and 5 disclose test results showing the return loss and insertion loss of an exemplary embodiment of the invention.
Figure 5:
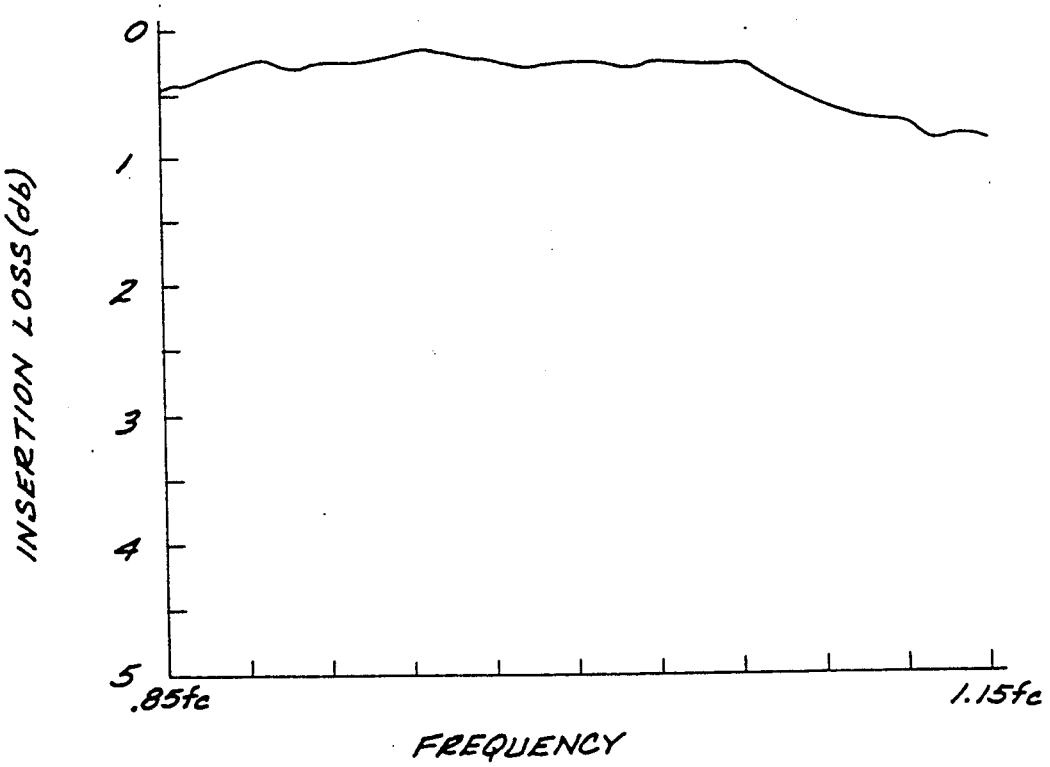

FIGS. 4 and 5 disclose actual test results of a microstrip-to-ridge waveguide transition constructed in accordance with the invention. The center frequency $f_c$ for this example is 10 Ghz.

It is understood that the above-described embodiment is merely illustrative of the possible specific embodiments which may represent principles of the present invention. Other arrangements may readily be devised in accordance with these principles by those skilled in the art without departing from the scope and spirit of the invention.

What is claimed is:

1. A microstrip transmission line to double ridge waveguide transition circuit, wherein the double ridge waveguide is characterized by an open end and by longitudinally extending ridge elements extending from respective long side walls of the waveguide into the waveguide interior, comprising:

a microstrip circuit, comprising a planar dielectric substrate having a circuit side and a ground plane side, the circuit side being selectively patterned with a conductive layer to define a balun network and a conductor line, the ground plane side being selectively patterned with a conductive layer to define a dipole immediately beneath the balun network and a ground plane surface area; and and wherein the microstrip circuit is substantially centered on the longitudinal sides of the waveguide adjacent said open end such that a gap exists between the dipole and the waveguide open end, the size of the gap selected for optimum VSWR.

2. The transition circuit of claim 1 wherein the waveguide is further characterized by a flange element disposed at said waveguide open end.

3. The transition circuit of claim 1 wherein said balun and said dipole provide a means for coupling microwave energy between said conductor line and said dipole.

4. The transition circuit of claim 1 wherein said dipole is characterized by a slot impedance, said conductor line is characterized by a first characteristic impedance, said balun network is characterized by a second characteristic impedance, and said circuit further comprises impedance transformation means for transforming from the characteristic impedance of the conductor line to the slot impedance of the dipole.

5. The transition circuit of claim 4 wherein said impedance transformation means comprises a step transformer, wherein the second characteristic impedance of the balun network is greater than the first characteristic impedance of the conductor line, and the slot impedance of the dipole is greater than the second characteristic impedance, said step transformer further comprising a transition conductor line connecting said conductor line to said balun network, said transition line characterized by a transition characteristic impedance, said transition impedance being greater than said first impedance but less than said second impedance.

6. The transition circuit of claim 5 wherein said first characteristic impedance is 50 ohms, said transition impedance is 60 ohms, said second impedance is 70 ohms, and said dipole slot impedance is 100 ohms.

7. A microstrip transmission line to double ridge waveguide transition circuit, wherein the double ridge waveguide is characterized by an open end and by longitudinally extending ridge elements extending from respective long side walls of the waveguide into the waveguide interior, comprising:

a microstrip circuit, comprising a planar dielectric substrate having a circuit side and a ground plane side, the circuit side being selectively patterned with a conductive layer to define a balun network and a conductor line, the ground plane side being selectively patterned with a conductive layer to define a dipole immediately beneath the balun network and a ground plane surface area, wherein said balun and said dipole provide a means for coupling microwave energy between said conductor line and said dipole; and wherein the microstrip circuit is centered on the longitudinal sides of the waveguide adjacent said open end such that a gap exists between the dipole and the waveguide open end, the size of the gap selected for optimum VSWR.

8. The transition circuit of claim 7 wherein the waveguide is further characterized by a flange element disposed at said waveguide open end.

9. The transition circuit of claim 7 wherein said dipole is characterized by a slot impedance, said conductor line is characterized by a first characteristic impedance, said balun network is characterized by a second characteristic impedance, and said circuit further comprises impedance transformation means for transforming from the characteristic impedance of the conductor line to the slot impedance of the dipole.

10. The transition circuit of claim 9 wherein said impedance transformation means comprises a step transformer, wherein the second characteristic impedance of the balun network is greater than the first characteristic impedance of the conductor line, and the slot impedance of the dipole is greater than the second characteristic impedance, said step transformer further comprising a transition conductor line connecting said conductor line to said balun network, said transition line characterized by a transition characteristic impedance, said transition impedance being greater than said first impedance but less than said second impedance.

11. The transition circuit of claim 10 wherein said first characteristic impedance is 50 ohms, said transition impedance is 60 ohms, said second impedance is 50 ohms, and said dipole slot impedance is 100 ohms.

* * * * *